United States Patent [19]

Fogarty

[11] Patent Number: 4,805,158

[45] Date of Patent: Feb. 14, 1989

[54] ACOUSTIC SIGNAL OPTICAL CORRELATOR USING A LIGHT EMITTING DIODE ARRAY

[75] Inventor: Edward J. Fogarty, Richboro, Pa.

[73] Assignee: The United States of America as represented by the Secretary of the Navy, Washington, D.C.

[21] Appl. No.: 858,156

[22] Filed: May 1, 1986

[51] Int. Cl.[4] ..... G06G 9/00

[52] U.S. Cl. ..... 367/125; 364/822; 364/824; 367/100

[58] Field of Search ..... 367/125, 124, 129, 100; 342/189; 364/822, 824

[56] References Cited

U.S. PATENT DOCUMENTS

| | | | |
|---|---|---|---|
| 3,392,392 | 7/1968 | Magnuski | 367/125 |
| 3,486,016 | 12/1969 | Faiss | 367/100 |
| 3,622,963 | 11/1971 | Sage | 367/125 |
| 3,919,707 | 11/1975 | Evans | 342/189 |
| 4,267,580 | 5/1981 | Bond et al. | 364/824 |
| 4,468,093 | 8/1984 | Brown | 342/189 |
| 4,519,046 | 5/1985 | Cole | 364/822 |
| 4,651,297 | 3/1987 | Schlunt | 364/822 |
| 4,669,054 | 5/1987 | Schlunt et al. | 364/822 |

*Primary Examiner*—Thomas H. Tarcza
*Assistant Examiner*—Tod R. Swann
*Attorney, Agent, or Firm*—Robert F. Beers; Henry Hansen; Susan E. Verona

[57] ABSTRACT

An optical correlator using a light emitting diode array, in which analog signals from two spaced sensors are correlated in order to locate and track a target. One signal is clipped and digitized and clocked through a shift register, and the other signal is delayed. The shift register is coupled to an LED array, element for element. Each shift register element modulates its corresponding LED element. The delayed signal is also connected at its output to the LED array via a transistor, and modulates each LED element. Therefore, the LED elements emit light in proportion to the product of the two signals. The emitted light is focused onto a CCD imaging array where it is integrated over a period of time before being sent to an integrator and output display device. The output is the correlation function versus the time delay between the two signals. Successive outputs display the movement of targets. Circuit design mitigates inherent errors within the system.

5 Claims, 1 Drawing Sheet

ACOUSTIC SIGNAL OPTICAL CORRELATOR USING A LIGHT EMITTING DIODE ARRAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to acoustic signal correlation, and more particularly to optical correlation using a light emitting diode (LED) array.

Broadband acoustic processing attempts to detect a target and track its path by the use of the target's wide frequency band energy sources. One important processing technique suited to broadband signal detection is correlation. Cross correlation is done by processing the signals from two spatially separated transducers or sensors, such as from two sonobuoys or from the multihydrophone array of a single buoy. The channels of information from these two transducers contain common broadband signals, which, because of the transducer spacing, are detected apart in time. The time delay depends upon the location of the target with respect to the two transducers. The correlator detects the broadband signals and determines the time delay. Correlation done in this way over time allows the target to be tracked.

Broadband acoustic processing requires the ability to perform intra-/inter-sensor data correlation at high speeds. Currently, this operation is performed digitally with high-speed array processing systems using both time domain and frequency domain methods. These processors make use of the fast Fourier transform and the inverse fast Fourier transform algorithms. Although these digital processors are fast, they are also large, complex, and consume large amounts of power.

The invention disclosed herein is an optical correlator. The signals from the transducers are processed optically, using a light emitting diode (LED) array and a charged coupled device (CCD) imaging array. Currently available optical correlators use acousto-optical cells having a fixed delay range equal to the transit time through the cell. These correlators are too fast to be used in low data rate processing and lack signal delay range flexibility and sensitivity.

SUMMARY OF THE INVENTION

It is therefore an object of the invention to provide an acoustic broadband signal processor which correlates optically using LED arrays.

Another object is to provide an optical correlator which can be placed in a sonobuoy.

Yet another object is to provide a correlator which does not consume large amounts of power.

Still another object is to provide a compact, light weight correlator for in-sonobuoy and airborne applications.

Another object is to provide both real-time and fast time processing capability in a correlator.

Briefly, these and other objects and features of the invention are accomplished in the following manner. The analog input channel of broadband acoustic signals from one of two spaced sensors is first digitized by coupling it to a clipper circuit, while the input from the other sensor is gain controlled and fed through a bulk delay CCD.

The digitized first input is then clocked through a digital shift register. An LED array having the same number of elements as the shift register to which it is coupled is modulated both by the output of its corresponding shift register element and by the output of the delayed input from the second sensor. Thereafter, the light output of each LED element is focused to an imaging CCD array and subsequently integrated over a period of time. At the end of the period, the electrons form a proportional correlation voltage, which is read out of the CCD imaging array and summed with its previous three output values to increase the overall post-processing integration time, and therefore also the signal processing gain, of the optical correlator by a factor of four. Errors due to nonuniformity of the LED elements are mitigated by alternately reversing the polarity of the delayed input signal, thereby cancelling out the errors. The correlation function versus the time delay is then displayed.

BRIEF DESCRIPTION OF THE DRAWINGS

Other objects, advantages and novel features of the invention will become apparent from the following detailed description of the invention when considered in conjunction with the accompanying drawings wherein.

DESCRIPTION OF THE PREFERRED EMBODIMENT

Figure 1:
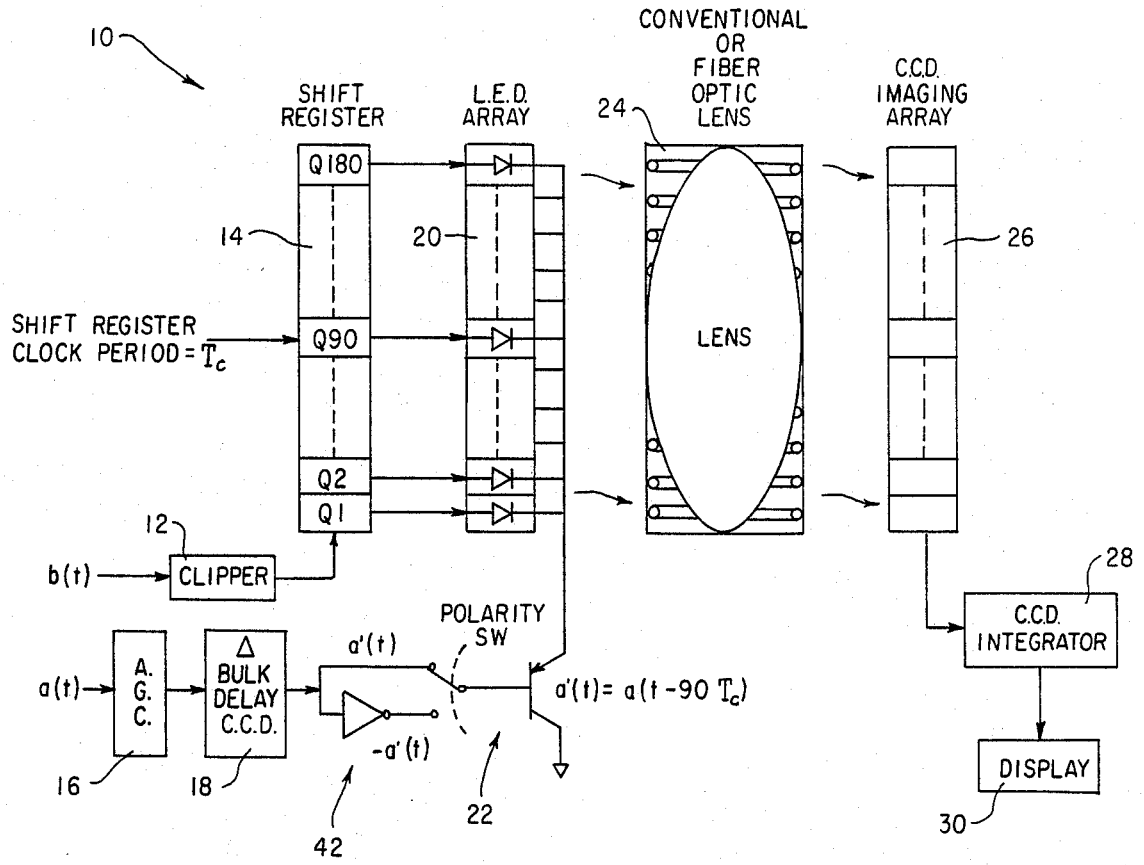
FIG. 1 is a schematic diagram of an optical correlator according to the invention.

Referring now to the drawings wherein like characters designate like or corresponding parts throughout the several views, there is shown a schematic diagram of the optical correlator. Two channels of bandpass filtered information, a(t) and b(t), are put into a correlator 10. One channel, b(t), is put into a clipper circuit 12, where it is digitized to a "one" or "zero" state. If the signal is positive it is given a "one" state, and if it is negative it is given a "zero" state. The digitized or clipped signal is then clocked through a digital shift register 14 having N elements, at a rate $f_c$. The value of $f_c$ should be at least 3.3 times the maximum frequency of the input signal. $T_c$, the length of time the signal remains in any one element, is equal to $1/f_c$. N, the number of elements, can be any number, for instance 180, and depends on the frequency of the signals and the spacing of the sensors.

The other channel, a(t), is sent through an automatic gain controller 16 and fed through a bulk delay charged coupled device (CCD) 18, so that the delay time with respect to b(t) is equal to ½ the total number of shift elements times the delay per element:

$$\text{bulk delay } (\Delta) = \tfrac{1}{2} N T_c.$$

If N=180, a(t) is delayed $90T_c$. The signal out of bulk delay CCD 18 is now $a(t-90T_c)=a'(t)$.

Shift register 14 is coupled to a light emitting diode (LED) array 20 having the same number of elements (N) as shift register 14. Each element of shift register 14 corresponds to one element of LED array 20. During any given clock cycle, each diode in LED array 20 is either enabled to light up or disabled from lighting up. If the corresponding LED array element is holding a "one", the diode is enabled; if it is holding a "zero", the diode is disabled. Enablement is provided by a voltage, whereas disablement is due to the absence of voltage. The voltage is provided or not by clipper circuit 12 when it digitizes the signal. Expressed mathematically, the output of the $m^{th}$ shift register element, $B(t-mT_c)$ is:

$$B(t-mT_c)=0 \text{ if } b(t-mT_c)\leqq 0$$

$$B(t-mT_c)=1 \text{ if } b(t-mT_c)>0$$

The LED elements are all connected at their cathodes to each other and then to the emitter of a transistor 22. Signal a'(t) is connected to the base of transistor 22. In this way, during any given clock cycle, each LED is also modulated by the delay signal a'(t), so that the light output of the mth LED element is the product of $B(t-mT_c)$ and a'(t). When $B(t-mT_c)=0$, the mth LED element does not light. When $B(t-mT_c)=1$, the LED lights in proportion to a'(t). However, if a'(t) is a low enough value, the LED element will not light at all. In order to make the LED's light up in proportion to a'(t), a'(t) is adjusted so that it operates within the linear illumination operating range of the diodes.

The resulting light output of each LED element is then focused through lens 24 to a corresponding element (or group of elements) of a CCD imaging array 26. CCD imaging array 26 receives the light and integrates it over time. The integration is achieved when the incident photons from each LED are converted to electrons and stored in an electron well within each CCD imaging array element. The electrons sum over the CCD array integration period, T. At the end of the integration period, the electrons form a proportional voltage which is read out of CCD imaging array 26.

Lens 24 may be either a conventional lens or a fiber optic lens array. A conventional lens projects the image from LED array 20 evenly across the entire photosensitive length of imaging array 26. Thus with a conventional lens, imaging array 26 may be shorter than LED array 20. A fiber optic lens array consists of two columns of tightly packed independent fiber lenses. Portions of the total image are transmitted by the individual fibers. The field of view of each fiber lens overlaps those of other fibers, thus making the image continuous in nature. A fiber optic lens array projects a rectangular, unity scale image onto imaging array 26.

CCD imaging array 26 integrates over a period of time, T, and then outputs the information into a CCD integrator 28. The integration time, T, chosen depends upon the length of imaging array 26 and is typically 0.250 seconds. The output of the mth array element at time t=kT is $$R_k(\tau_m) = \int_{(k-1)T}^{kT} B(t-mT_c)\cdot a(t-\tfrac{1}{2}NT_c)dt$$

where $\tau_m=(mT_c-\frac{1}{2}NT_c)=(m-\frac{1}{2}NT_c)$ and k is a positive integer and m=1, 2, . . . , N. The value of $R_k(\tau_m)$ represents the correlation factor at time $t=kT$ for a time delay value of $\tau_m$. The output of imaging array 26 at the end of the integration period between times $t=(k-1)T$ and $t=kT$ is a series of voltages proportional to the values of $R_k(\tau_1)$ through $R_k(\tau_N)$. Each correlation voltage $R_k(\tau_m)$ is summed with its previous three output values in order to increase the overall integration time by four. Thus:

$$R(\tau_m,kT) = \sum_{j=0}^{3} R_{k-j}(\tau_m)$$

$R(\tau_m, kT)$ is then displayed on an output display device 30, Each sweep of the pen on display device 30 displays $R(\tau, kT)$ for the full range of $\tau$ values at time kT. The data display on subsequent sweeps shows how the correlation function varies in time for each value of $\tau$.

Figure 2:
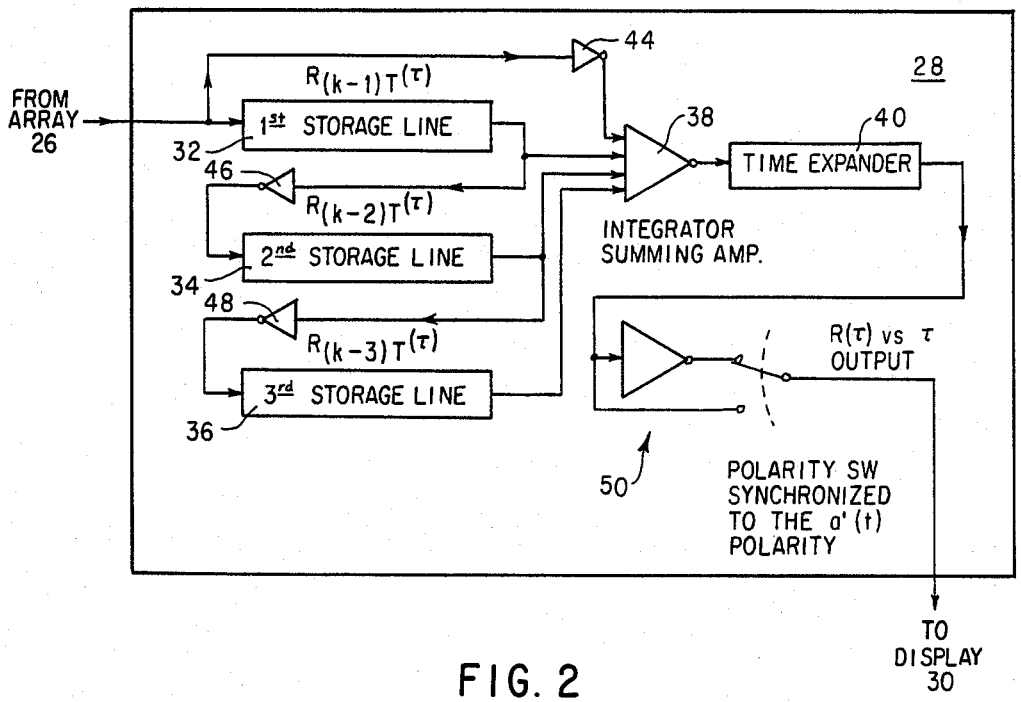
FIG. 2 is a schematic diagram of the integrator of the optical correlator of FIG. 1.

FIG. 2 shows in greater detail CCD integrator 28.

Data from CCD imaging array 26 is loaded into first, second, and third storage lines, 32, 34, and 36 serially. The image stored on imaging CCD array 26 during one integration period, T, is sent to first storage line 32. First storage line 32 sends what it was holding into second storage line 34, which sends what it was holding to third storage line 36. During any given integration period, kT, first storage line 32 is holding the correlation voltage $R_{(k-1)T}(\tau)$, and second storage line 34 is holding $R_{(k-2)T}(\tau)$, and third storage line 36 is holding $R_{(k-3)T}(\tau)$. At the end of each integration period imaging array 26 and the three storage lines 32, 34, and 36 output in parallel. The output from each is summed in an integrator summing amplifier 38 and sent to a time expander 40. In this way, each new output from imaging array 26 is summed with its previous three outputs thereby increasing the overall integration time of the optical correlator 10 by a factor of four.

FIG. 2 also shows how repetitive errors due to nonuniformities amongst the light emitting diodes are corrected. Each diode inherently outputs slightly more or less than the signals would otherwise cause it to. These diode error outputs are summed with the signal and would compound when added three more times if not corrected. Correction is accomplished by reversing the polarity of a'(t) every T seconds. This is accomplished by first polarity switch 42. The output of imaging array 26 after any given integration period is stored in first storage line 32 at the same polarity, but is also sent through a first inverting amplifier 44 before going to integrator summing amplifier 38. The output from first storage line 32 goes to integrator summing amplifier 38 to be summed with imaging array 26 output as well as through a second inverting amplifier 46 to second storage line 34. The output from second storage line 34 goes both to integrator summing amplifier 38 and through a third inverting amplifier 48 to third storage line 36. Output from third storage line 36 is summed with the other line outputs at integrator summing amplifier 38. As shown in FIG. 2, this arrangement makes the outputs of imaging array 26 and the three storage lines, 32, 34, and 36 the same polarity. A second polarity switch 50 at the output of time expander 40 changes the polarity of the $R(\tau, kT)$ output to be synchronous with the changes in the polarity of a'(t). In this way the output is always positive. Time expander 40 takes the integrator output, $R(\tau, kT)$ and expands it to a length of time that is suitable for display device 30, typically 0.250 seconds. The sweep rate is equal to, and synchronized with, the integration period, T.

In operation, signals a(t) and b(t) from two spaced sensors input into optical correlator 10. Signal b(t) is clipped and digitized and clocked through shift register 14. Signal a(t) is automatically gain-controlled and then put through bulk delay CCD 18. Both signals are connected to LED array 20 in such a way as to modulate the light emitted from each diode. The emitted light is focused via lens 24 onto CCD imaging array 26, which integrates it over a fixed period of time, T. At the end of each time period, T, imaging array 26, outputs to CCD integrator 28, which sums the output with the three previous outputs. These sums are then sent to display device 30. The polarity of the delayed signal is reversed every T seconds to correct for inherent non-uniformities in the diodes of LED array 20.

Some of the many features and advantages of the invention should now be readily apparent. The optical correlator has excellent processing capabilities. It offers a wide range of processing speeds and bandwidths within a compact, low-powered package. Use of the optical fiber lens array gives the additional advantages of being light, rugged, inexpensive, and compact. The optical correlator disclosed herein is also adaptable to multi-channel operation. These features make this correlator adaptable to airborne, post-flight analysis, and insonobuoy applications.

Alternative configurations of the optical correlator are possible. The correlator could be built with longer LED and imaging arrays in order to increase the maximum value of time delay ($\tau$max) measurable. The output of the imaging CCD array could be analog-to-digitally converted and post-processed by a microprocessor for further integration and output formating. It will be understood that the above description of the present invention is susceptible to various other modifications, which are intended to be comprehended within the meaning and range of equivalents of the appended claims.

What is claimed is:

1. An optical correlator for correlating first and second analog signals comprising in combination:

clipper means for receiving the first signal and producing a series of binary voltages indicative of the polarity of the first signal;

a shift register having a plurality of elements operatively connected to said clipper means for sampling the series serially at a given delay time per element and outputting the binary voltages in parallel;

light emitting diodes operatively connected to said shift register for receiving the parallel voltages at respective ones of said diodes and emitting light in response thereto;

delay means for receiving the second analog signal and producing a replica signal thereof that is delayed with respect to the first analog signal by a time duration equal to the product of half of the quantity of shift register elements and the delay time per element;

modulator means operatively connected between said diodes and said delay means for receiving the replica signal and modulating the emitted light in response thereto;

imaging elements positioned adjacent to said diodes for receiving and integrating the modulated light from respective ones of said diodes over each of successive time intervals and producing a voltage proportional to the light integrated in each of the intervals.

2. An optical correlator according to claim 1 further comprising:

an integrator operatively connected to said imaging elements for receiving and summing the voltages of one interval and a plurality of immediately preceding intervals.

3. An optical correlator according to claim 2 wherein said integrator comprises:

storage lines connected in series, each successive one receiving and storing the voltages from the preceding interval;

summing means operatively connected to said storage lines and said imaging elements for receiving and summing the voltages from each of said storage lines and said imaging elements; and a time expander operatively connected to said summing means for receiving the summed voltages and producing an output signal over a longer time period than that in which the voltage were received.

4. An optical correlator according to claim 3 further comprising:

compensating means operatively connected to said integrator and between said modulator means and said delay means for compensating for inherent nonuniformity of said diodes.

5. An optical correlator according to claim 4 wherein said compensating means comprises:

a first polarity switch operatively connected between said modulator means and said delay means for switching the polarity of the second analog signal at the end of each of said time intervals;

a second polarity switch operatively connected to said time expander for switching the polarity of the output signal synchronously with said first polarity switch;

a first inverter operatively connected to said imaging elements for inverting the voltages to said summing means;

storage line interverts connected between successive ones of said storage lines for inverting the voltages; and a second inverter operatively connected between said summing means and said time expander for inverting the summed voltage from said summing means.

* * * * *